United States Patent [19]

Landsman et al.

[11] 3,946,912

[45] Mar. 30, 1976

[54] ACTUATOR CAP FOR AEROSOL DISPENSER

[76] Inventors: Emanuel Landsman, 245 N. Broadway, Yonkers, N.Y. 10706; Irving Landsman, 3530 Henry Hudson Parkway, Riverdale, N.Y. 10463

[22] Filed: Jan. 2, 1975

[21] Appl. No.: 537,913

[52] U.S. Cl. ..... 222/402.13

[51] Int. Cl.[2] ..... B65D 83/14

[58] Field of Search ..... 215/9; 222/402.11, 402.12, 222/402.13; 239/337, 373; 251/297

[56] References Cited

UNITED STATES PATENTS

| | | | |
|---|---|---|---|
| 2,912,173 | 11/1959 | Edwards | 239/373 X |
| 2,913,749 | 11/1959 | Ayres | 222/402.12 X |
| 3,100,619 | 8/1963 | Berghofer et al. | 251/297 X |
| 3,409,186 | 11/1968 | Melocchi | 222/402.13 |
| 3,608,785 | 9/1971 | Durso et al. | 222/402.13 |
| 3,844,448 | 10/1974 | Sette | 222/402.11 X |

*Primary Examiner*—Robert B. Reeves
*Assistant Examiner*—Norman L. Stack, Jr.
*Attorney, Agent, or Firm*—Arthur B. Colvin

[57] ABSTRACT

The invention relates to a safety cap for a device for dispensing a liquefied gas propellent including one or more active ingredients such as is used for insecticides or exterminating purposes. More particularly, the device, which is commonly known as an "Aerosol Bomb" comprises a container of conventional type having a discharge nozzle which when pressed will activate a valve to release the contents of the container as a spray. The container has an annular flange at its upper end and the cap, according to the invention, has a cylindrical side wall with means at its lower edge to interengage with the annular flange to retain the cap in position yet permit relative longitudinal movement of the cap with respect to the nozzle. The cap has inwardly movable means carried by the side wall thereof releasably to grip the nozzle so that when the cap is moved longitudinally outwardly with respect to the container; the gripping means are then moved inwardly to engage the nozzle and the cap is then moved longitudinally inwardly with respect to the container with the nozzle still gripped, the valve controlled by the nozzle will be actuated for discharge of the contents of the container.

13 Claims, 12 Drawing Figures

ACTUATOR CAP FOR AEROSOL DISPENSER

As conducive to an understanding of the invention it is noted that with the ever increasing use of aerosol cans in the home to dispense a wide variety of products, situations have arisen in which young children, who are unaware of the potential danger of the product, particularly when the active agent is an insecticide, pick up the can and actuate the latter with resultant harmful consequences.

Numerous types of safety caps have been devised to prevent inadvertent actuation by a child. However, in many cases such caps are either so complex that it is even difficult for an adult to use without detailed instructions, or so simple that they also can be operated by a child.

Furthermore, where the safety caps include numerous movable elements and locking mechanisms, the cost of manufacture renders them commercially unfeasible and they are likely to become damaged if the container is dropped.

It is accordingly among the objects of the invention to provide a safety cap for a pressurized dispenser or aerosol bomb of the type comprising a conventional container having a discharge nozzle, which cap may readily be fabricated at low cost with a simple molding operation and which is devoid of pivots, links, plungers or other movable elements that are not an integral part of the cap, and which cap itself defines the actuating means for depressing the nozzle of the dispenser with a few simple movements which may readily be accomplished by an adult but which are beyond the capabilities of a young child.

It is also to be noted that in many applications of "Aerosol Bombs", particularly when they contain an insecticide, not only is it desirable to prevent inadvertent actuation by a child, but it is often desirable that once the device is actuated it remain in such actuated condition so that the user can leave the room in which the device is discharging in that he not be affected by the toxic spray or discharge.

Accordingly it is still another object of the invention to provide a safety cap of the above type, which when operated to discharge the contents of a container will remain in its actuated condition without need for the user to hold the cap.

According to the invention these objects are accomplished by the arrangement and combination of elements hereafter described and more particularly recited in the claims.

In the accompanying drawings in which are shown one or more of various possible embodiments of the several features of the invention:

Figure 1:
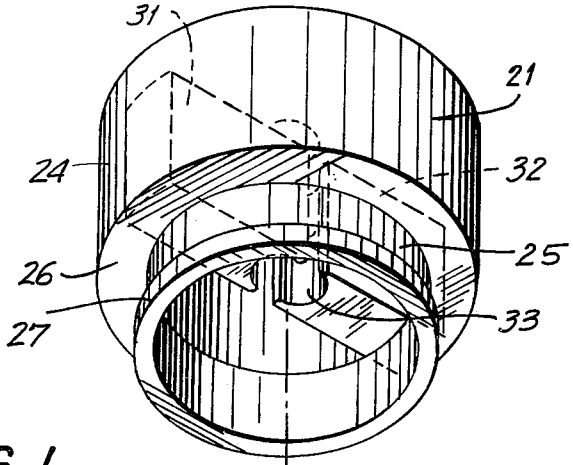
FIG. 1 is a perspective view of the aerosol container and safety cap, according to one embodiment of the invention.
Figure 1:
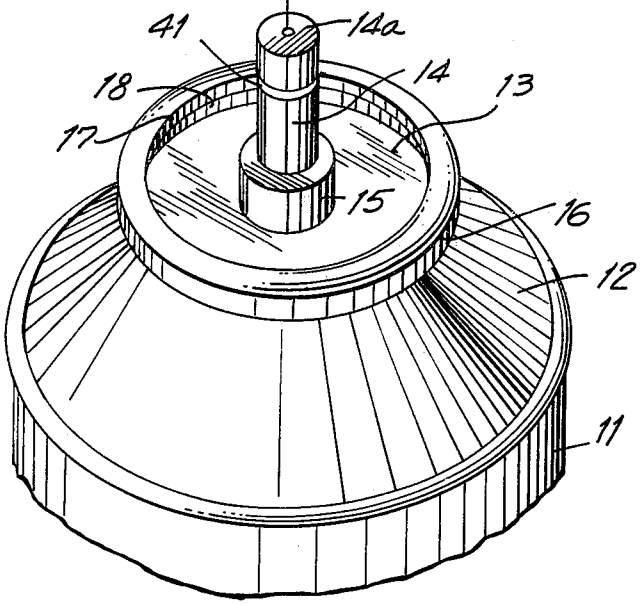

Referring now to the drawings, as shown in FIG. 1, the liquefied gas propellent, as well as the active ingredients comprising the insecticide, are enclosed under pressure in a container 11. The container has an upwardly domed end 12 surrounding the end wall 13 of the container, from which protrudes an axial discharge nozzle 14, which coacts with a valve 15, which is opened when the nozzle 14 is depressed to permit ejection of the contents of the container through the nozzle 14 in the form of a spray.

The domed end 12 of the container has an annular rim 16 rising therefrom, the latter having an inwardly extending annular flange 17 defining an annular recess 18 with respect to the end wall 13 of the container.

According to the invention in the embodiment shown in FIGS. 1 to 6 a cup-shaped cap 21 is provided which preferably is formed by molding from a suitable plastic such as polyethylene. The cap is sufficiently rigid so as to maintain its shape and properly protect the nozzle yet may be deformed in order to actuate the nozzle in the manner hereinafter to be described.

Figure 2:
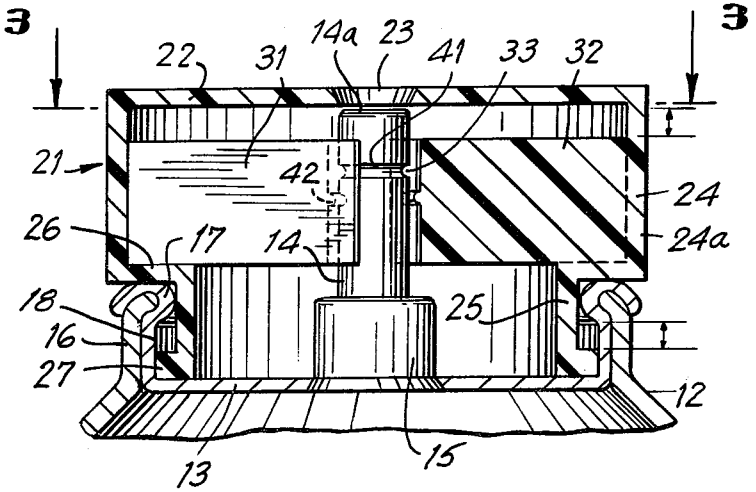
FIG. 2 is a longitudinal fragmentary sectional view of the safety cap mounted on the aerosol can in normal position.
Figure 3:
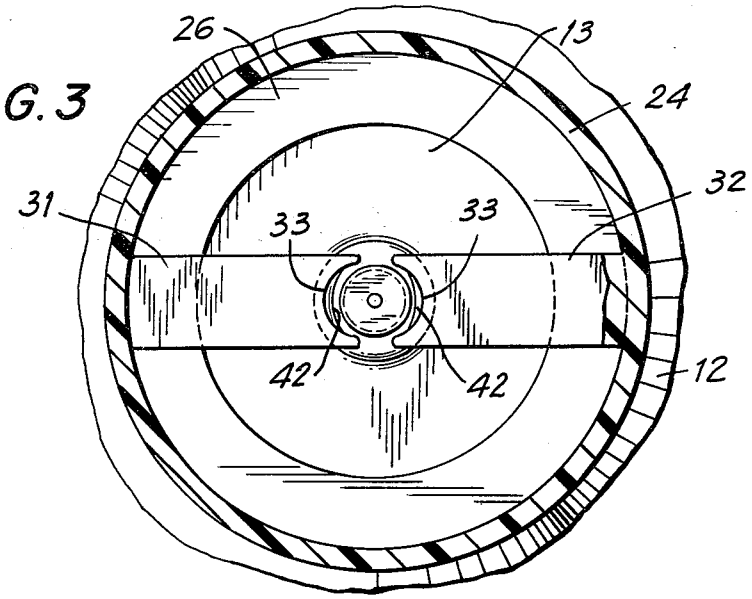
FIG. 3 is a sectional view taken along line 3—3 of FIG. 2.

More particularly, as shown in FIGS. 1 and 2, the cap has a top wall 22 with an axial opening 23 and has a depending cylindrical side wall 24 of reduced diameter at its lower end as at 25 defining an annular shoulder 26, an annular flange 27 extending outwardly from the lower end of reduced diameter wall portion 25.

The flange 27 is of diameter such that it may be force fitted over annular flange 17 so that flange 27 will be positioned in annular recess 18 and movable longitudinally therein.

As a result of the "elastic memory" of the plastic forming the cap 21, after the lower portion 25 is deformed inwardly to permit the annular flange 27 to snap over the annular flange 17, it will then return to its original shape. As a result, the cap 21 will be dependably secured to the annular rim 16 yet able to be moved axially with respect thereto.

Extending radially inwardly from opposed sides of the cap 21 and diametrically aligned therewith are ribs 31, 32. The outer end of each of the ribs 31, 32 is preferably formed integrally with the upper portion **24*a* of the side wall 24 and the inner end of each of the ribs is formed with a substantially semi-circular clamping recess 33. Due to the thickness in cross section of each of the ribs 33, they are relatively rigid as compared to the rigidity of the side and top walls 24, 22 of the cap 21** for the purpose hereinafter described.

With the cap 21 mounted on the upstanding rim 16, and with the shoulder 26 seated on the annular flange 17 at the upper edge of rim 16, due to the length of the lower portion 25 of side wall 24 the inturned flange will be be located adjacent the end wall 13 of the container.

With the cap 21 initially positioned as above described, the nozzle 14 will be straddled and substantially encompassed by the opposed recesses 33, the latter defining a substantially cylindrical bore of diameter just slightly larger than the diameter of nozzle 14. The length of the nozzle 14 is such that its outer end 14*a* will be slightly spaced from the under surface of top wall 22 of the cap 21 axially aligned with the opening 23 therein.

In order to actuate the valve 15, the user must grasp the container 11 in one hand and then lift up on the cap 21 with the other hand, such upward movement of the cap being limited by the abutment of flange 27 against flange 17. As a result of such upward movement of the cap, it will be positioned as shown in FIG. 4 and the recesses 33 at the ends of ribs 31, 32 will also be displaced upwardly with respect to the nozzle 14.

Figures 4, 5, 6, 7, 8:
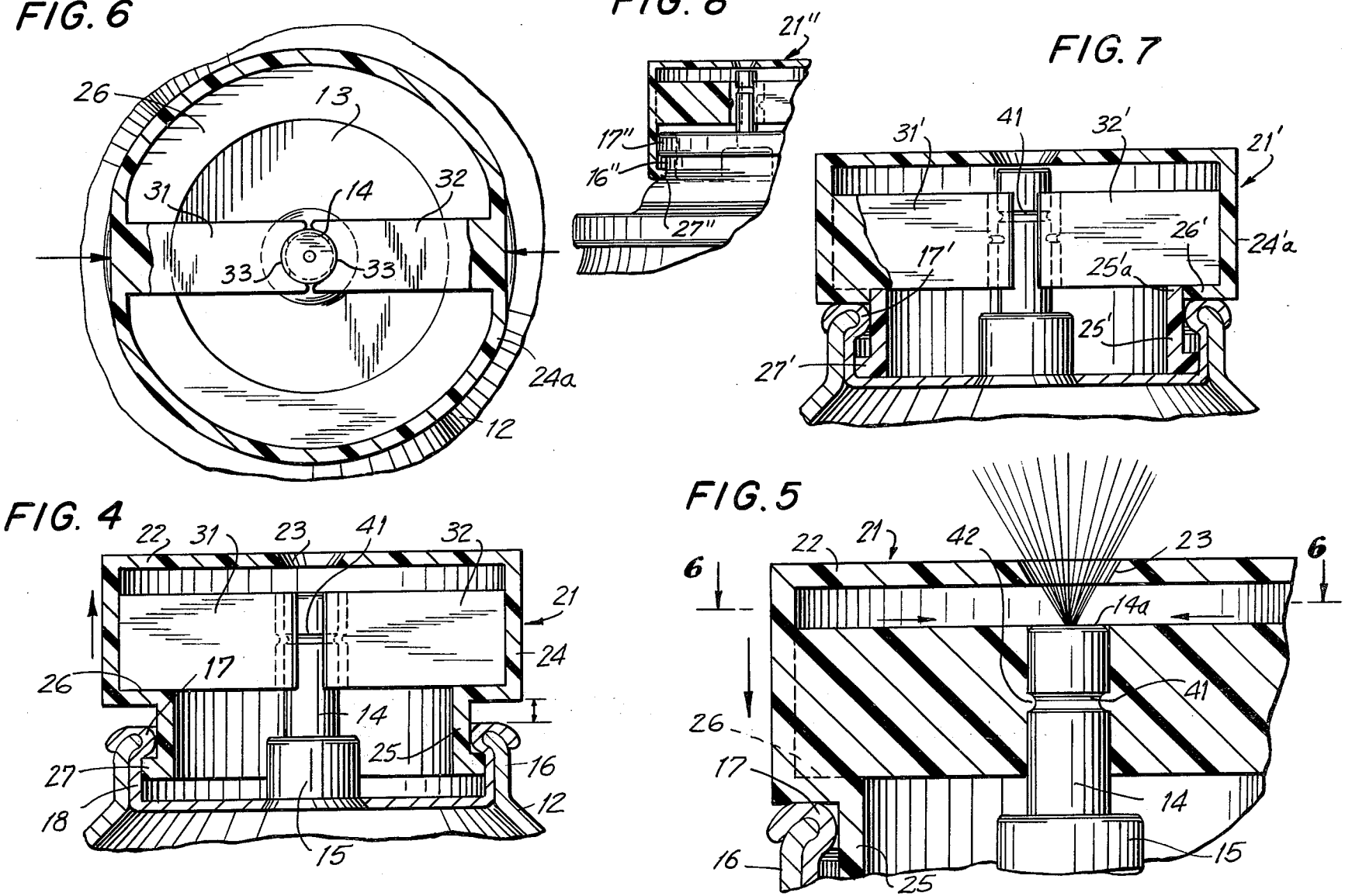
FIG. 4 is a view similar to FIG. 2, showing the cap in a second position of operation.
FIG. 5 is a view similar to FIG. 2, showing the cap in position actuating the valve.
FIG. 6 is a sectional view taken along line 6—6 of FIG. 5.
FIG. 7 is a view similar to FIG. 2, showing the cap made of two portions of different flexibility.
FIG. 8 is a fragmentary detail view of another embodiment of the invention.

Thereupon the user, still gripping the container 11 in one hand, presses inwardly on opposed sides of the upper portion 24*a* at the regions thereof shown by the arrows in FIG. 6 of the cap diametrically aligned with the ribs 31, 32 such positions being indicated by appropriate markings on the exterior of said wall portion 24. As a result of such inward forces, due to the rigidity of the ribs 31, 32 and the flexibility of the side wall 24 of the cap 21, the side wall 24 will deform inwardly at the regions of pressure as shown in FIG. 6, forcing the ribs 31, 32 inwardly so that the opposed wall surfaces of the recesses 33 will tightly grip the nozzle 14 therebetween.

Thereupon, still pressing inwardly on the opposed portions of side wall 24 of the cap with one hand and holding the container in the other hand, the user then moves the cap downwardly to the position shown in FIG. 5. As a result, the nozzle 14 will be moved downwardly and the distance of travel of the cap 21 is such that the valve 15 will be actuated so that the contents of the container will be discharged through opening 23.

If the user should release the pressure applied to the opposed portions of side wall 24, due to the elastic memory of the plastic material from which the cap is formed, the latter will assume its original shape so that the ribs 31, 32 will move outwardly, with the result that the wall surfaces of recesses 33 will move away from nozzle 14. Hence, due to the conventional spring controlling the valve 15, the nozzle 14 will be forced outwardly and the valve 15 will close, cutting off further discharge.

It is apparent that unless the operating procedures above described are followed in the sequence indicated, the valve 15 cannot be actuated. The procedure is of course relatively simple for an adult to follow but would be extremely difficult to be performed by a young child and the likelihood of accidental operation by such young child is minimal, if not impossible.

Thus, for example, with the cap in its normal downward position shown in FIG. 2, if downward pressure is exerted against the top wall 22 of the cap, as the shoulder 26 abuts against flange 17, no downward movement would be imparted to the cap. Hence no downward movement would be imparted to the nozzle 14 which could cause actuation of valve 15.

If downward pressure should be exerted against the cap 21 and the sidewall portion 24 should be pressed inwardly simultaneously causing the recesses 33 to grip the nozzle, since as above described, the cap would not move downwardly, no actuation of valve 15 could occur.

Even if by some remote chance the child should first lift the cap 21 so that it moved upwardly with respect to the container, and then the child pressed the cap downwardly, no actuation of the nozzle would occur unless the child at the same time gripped the container in one hand and pressed the portion of side wall 24 at the regions thereof aligned with ribs 31, 32. The likelihood of such relatively complex procedure being inadvertently performed is of course highly improbable.

Although in the embodiment shown in FIGS. 1 to 6 the cap 21 is a one piece unit which may readily be molded, it is within the scope of the invention to form the cap in two pieces.

Thus the cylindrical reduced diameter lower portion 25' of the cap 21' shown in FIG. 7 could be formed from an extremely rigid plastic or of metal, both capable of deforming inwardly sufficiently so that flange 27' thereof could snap over flange 17'. The remaining portion 24'*a* of the cap could be molded from a more flexible plastic and the two sections secured together by bonding the upper edge 25'*a* of portion 25' to the periphery of shoulder 26' and to the under surface of ribs 31', 32'.

It is also within the scope of the invention in order to insure dependable actuation of the valve 15 controlled by the downward movement of nozzle 14, to provide the nozzle 14 with an annular groove 41 and the wall surfaces of recesses 33 with arcuate beads 42, so that when the cap 21 was lifted in normal operation the beads 42 would be aligned with the annular groove 41 and would move into such annular groove 41 when the opposed portions of side wall 24*a* of the cap were pressed inwardly.

Although in the embodiment shown in FIGS. 1 to 6, for example, the cap 21 is retained on the upstanding rim 16 by having the flange 27 of the cap positioned inwardly of the rim 16, it is within the scope of the invention as shown in FIG. 8 to have the flange 27'' positioned exteriorly of the upstanding rim 16'' so that it will engage the outwardly extending flange 17'' when the cap 21'' is lifted.

In the embodiments shown in FIGS. 1 to 7, manual pressure must be maintained against the sides of the cap 21 to maintain the valve 15 actuated.

In the embodiments shown in FIGS. 9 to 12 inclusive, the same safety features are present as in the embodiments of FIGS. 1 to 8, but in addition once the device is actuated it will remain in such condition.

Figure 11:
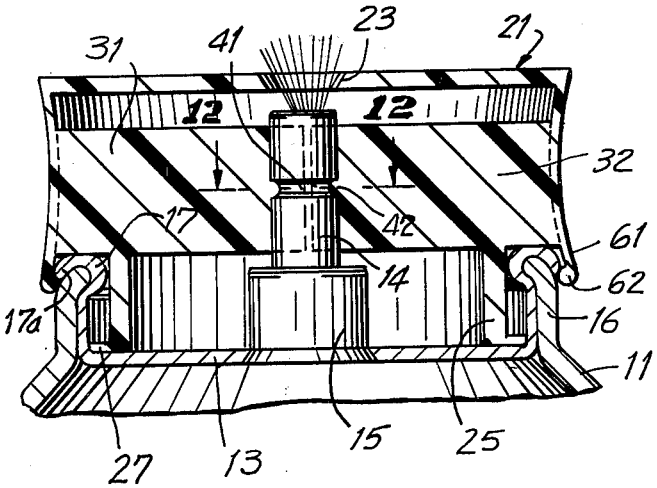
FIG. 11 is a view similar to FIG. 9, showing the cap in actuated position.

To this end, as shown in FIGS. 9 to 12 in which parts corresponding to those in FIGS. 1 to 6 have the same reference numerals, the side wall 24 of the cap 21 includes a depending lip 61 with an inwardly extending annular flange 62 at its lower edge. The inner diameter of flange 62 is slightly less than the outer diameter of a flange 17*a* extending outwardly beyond upstanding rim 16 so that when the cap 21 is pressed downwardly as shown in FIG. 11 the flange 62 will engage flange 17*a* to retain the cap in such position.

Figure 9:
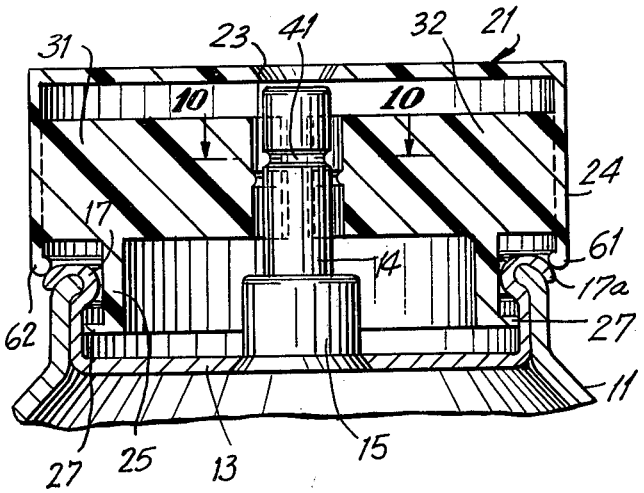
FIG. 9 is a view similar to FIG. 2 of still another embodiment of the invention which enables the discharge nozzle to be locked in actuated position.
Figure 10:
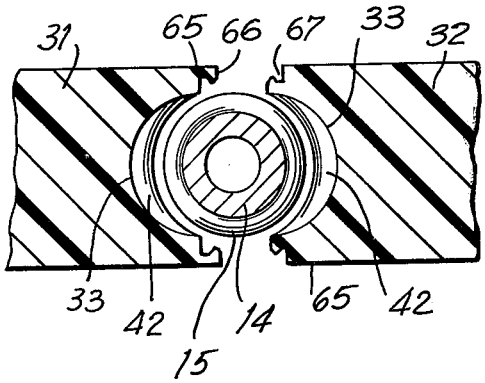
FIG. 10 is a detail sectional view taken along line 10—10 of FIG. 9.

In the normal position of the cap 21 as shown in FIG. 9 with the flange 62 resting on the top of rim 16, the annular side wall 25 which depends from ribs 31, 32 and is positioned inwardly of rim 16 will have its outwardly extending annular flange 27 positioned substantially midway between the inwardly extending flange 17 and the floor 13 so that the cap 21 may be moved upwardly or downwardly from the position shown in FIG. 9.

The recesses 33 defined at the inner ends of ribs 31, 32 each has an arcuate bead 42 formed integrally therewith adapted to coact with annular groove 41 in nozzle 14 in the manner previously described.

The side edges 65 of each of the ribs 31, 32 are provided with complementary locking members 66, 67 which will snap into locking engagement when the ribs 31, 32 are moved inwardly by pressure against opposed portions of the side wall 24 of cap 21 aligned with such ribs.

More particularly in the operation of the embodiment shown in FIGS. 9 to 12, to actuate the valve 15 the cap 21 must first be moved outwardly from the position shown in FIG. 9, such movement being limited by the abutment of flange 27 against flange 17. At such outward position of the cap 21, the beads 42 will be aligned with annular groove 41 of nozzle 14.

Figure 12:
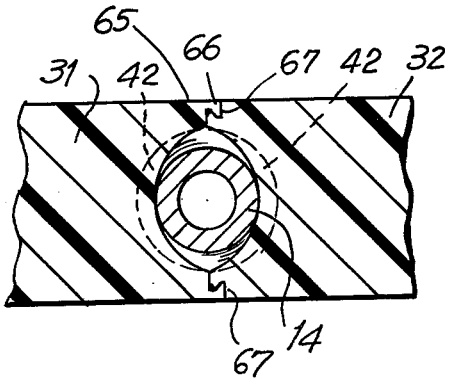
FIG. 12 is a detail sectional view taken along line 12—12 of FIG. 11.

Thereupon the portions of side wall 24 of the cap 21 aligned with ribs 31, 32 are pressed inwardly and the beads 42 will enter groove 41 as shown in FIGS. 11, 12 and at the same time the complementary locking members 66, 67 will snap into engagement as shown in FIG. 12 to retain the beads 42 in said groove 41.

At this time, the cap 21 is moved downwardly to the position shown in FIG. 11 so that the flange 62 will engage flange 17*a* to retain the cap in its downward locked position.

The downward movement of cap 21 from the position shown in FIG. 9 to the position shown in FIG. 11 is sufficient to cause corresponding inward movement of nozzle 14 a distance to actuate the valve 15 so that the contents of the container 11 will be discharged continuously from the nozzle 14.

It is to be noted that the spacing between the complementary locking members 66, 67 is such that they will not engage unless the beads 42 are aligned with groove 41 at the time the ribs 31, 32 are moved inwardly.

Having thus described our invention, what we claim as new and desire to secure by Letters Patent of the United States is:

1. A cap for an aerosol bomb of the type comprising a container with an end wall having a longitudinally outstanding annular rim with an annular retaining flange at its free end and having a discharge nozzle extending axially from said end wall and a normally closed valve actuated by inward movement of said nozzle; said nozzle having actuator engagement means thereon at a point intermediate its length and spaced substantially from its outlet end, said cap having a side wall, means at one end of said side wall inter-engaging with said retaining flange for retention of said cap on said rim yet permitting limited relative longitudinal movement between said cap and said rim and nozzle a predetermined distance between a retracted dispensing position and an extending nondispensing position, and inwardly movable actuator means carried by said cap to grip said actuator engagement means on said nozzle for axial inward movement of said nozzle and actuation of said valve only when said cap is moved from said extended position to said retracted position and said inwardly movable actuator means are actuated, said cap having means to permit discharge therethrough of the contents of said container when the valve is actuated.

2. The combination set forth in claim 1 in which the cap has a top wall and said means to permit discharge comprises an axial opening in said top wall aligned with the outlet end of the nozzle.

3. The combination set forth in claim 1 in which the retaining flange at the free end of the container rim extends radially inwardly and the means on one end of said side wall inter-engaging with said retaining flange comprises an outwardly extending annular flange.

4. The combination set forth in claim 1 in which said side wall of said cap is deformable, whereby when opposed portions of said side wall aligned with said inwardly movable actuator means are deformed inwardly said nozzle actuator engagement means will be gripped by said movable actuator means.

5. The combination set forth in claim 1 in which the side wall of said cap is deformable and said inwardly movable actuator means comprises a pair of diametrically aligned ribs, each rib having one end secured to the side wall of the cap extending radially inward therefrom and the other end positioned adjacent to the nozzle.

6. The combination set forth in claim 1 in which the side wall of said cap is deformable and said inwardly movable actuator mean comprises a pair of diametrically aligned ribs, each rib having one end secured to the side wall of the cap and extending radially inward therefrom, a clamping recess formed at the other end of each of said ribs, the wall of each recess being in juxtaposition with said nozzle and adapted to engage the actuator engagement means on the latter when the opposed portions of the side wall aligned with said ribs are deformed inwardly.

7. The combination set forth in claim 6 in which each of said recesses is arcuate and said recesses and said nozzle actuator engagement means have complementary locking conformations normally spaced from each other and adapted to engage when said side wall of the cap is deformed inwardly.

8. The combination set forth in claim 6 in which said nozzle actuator engagement means includes an annular groove and each of said recesses is arcuate and has an arcuate bead normally spaced from said groove and adapted to be aligned therewith and positioned therein when the side wall of said cap is deformed inwardly.

9. The combination set forth in claim 6 in which said nozzle actuator engagement means includes an annular groove, each of said recesses is arcuate and has an arcuate bead, said beads normally being spaced from said annular groove, and adapted to be aligned therewith and positioned therein when the side wall of the cap is deformed inwardly, each of said ribs having complementary locking members at their inner ends adapted to engage when the beads are aligned with said groove and the side wall of the cap is deformed inwardly, and means releasably to retain the cap in its retracted position.

10. The combination set forth in claim 9 in which the annular retaining flange extends radially inwardly and a second annular retaining flange is provided extending radially outwardly, the means releasably to retain the cap in its retracted position comprises an annular lip depending from the lower edge of the side wall of the cap and encompassing said second annular flange, said lip having an annular inwardly extending flange at its lower edge adapted to coact with said second flange, said means interengaging with said first flange comprising an outwardly extending annular flange positioned inwardly of said annular rim and located between said first flange and the end wall of the container when said lower edge of said lip rests on the upper edge of said rim.

11. The combination set forth in claim 1 in which said cap has a cylindrical deformable side wall and is of reduced diameter at its lower portion defining an annular shoulder therebetween, said cap having a top wall extending across one end of said side wall, said top wall having an axial opening, said interengaging means comprising an outwardly extending annular flange at the end of said lower portion of said side wall, said inwardly movable means comprises a pair of diametrically aligned ribs, each rib having one end secured to the side wall between the annular shoulder and the top wall and extending radially inward therefrom, each rib having clamping means at its inner end.

12. The combination set forth in claim 11 in which the lower portion of said side wall is relatively rigid as compared to the rigidity of the upper portion of said side wall.

13. The combination set forth in claim 1 in which such annular retaining flange extends outwardly from the upper edge of said annular rim, and the side wall of said cap encompasses said rim and said retaining flange and the means at one end of said side wall interengaging with said retaining flange comprises an inwardly extending annular flange at the lower end of said side wall.

* * * * *